US011105336B2

(12) United States Patent
Iwakiri

(10) Patent No.: US 11,105,336 B2
(45) Date of Patent: Aug. 31, 2021

(54) IMPELLER AND CENTRIFUGAL COMPRESSOR

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 51 days.

(21) Appl. No.: 16/475,423

(22) PCT Filed: Mar. 29, 2017

(86) PCT No.: PCT/JP2017/013028
§ 371 (c)(1),
(2) Date: Jul. 2, 2019

(87) PCT Pub. No.: WO2018/179173
PCT Pub. Date: Oct. 4, 2018

(65) Prior Publication Data

US 2019/0331126 A1 Oct. 31, 2019

(51) Int. Cl.

| | |
|---|---|
| ***F04D 29/66*** | (2006.01) |
| ***F04D 29/30*** | (2006.01) |
| ***F04D 29/28*** | (2006.01) |

(52) U.S. Cl.
CPC ..... *F04D 29/30* (2013.01); *F04D 29/284* (2013.01); *F04D 29/666* (2013.01)

(58) Field of Classification Search
CPC ..... F04D 29/30; F04D 29/284; F04D 29/666; F05D 2220/40
See application file for complete search history.

(56) References Cited

U.S. PATENT DOCUMENTS 4,615,659 A 10/1986 Sidransky
6,589,013 B2 * 7/2003 Abdallah ..... F04D 17/127 415/199.2

(Continued)

FOREIGN PATENT DOCUMENTS

GB 693686 A 7/1953
JP 5-83397 U 11/1993

(Continued)

OTHER PUBLICATIONS

Extended European Search Report for European Application No. 17903630.6, dated Dec. 9, 2019.

(Continued)

*Primary Examiner* — David E Sosnowski
*Assistant Examiner* — Sabbir Hasan
(74) *Attorney, Agent, or Firm* — Birch, Stewart, Kolasch & Birch, LLP.

(57) ABSTRACT

The present invention is provided with: an annular hub 7 having a circularly formed axial cross-section; a plurality of first blades 8 that are arranged on the outer circumferential surface of the hub 7; and a plurality of second blades 9 that are arranged closer to the downstream-side in the flow direction of fluid than the rear edges 8*b* of the first blades 8, in the outer circumferential surface of the hub 7, wherein the number of the second blades 9 is less than a double that of the first blades 8.

3 Claims, 11 Drawing Sheets

(56) References Cited

U.S. PATENT DOCUMENTS

| | | | |
|---|---|---|---|
| 2012/0272663 | A1 | 11/2012 | Moussa et al. |
| 2018/0010464 | A1 | 1/2018 | Yokoyama et al. |

FOREIGN PATENT DOCUMENTS

| | | | |
|---|---|---|---|
| JP | 2002-349487 | A | 12/2002 |
| JP | 2012-233475 | A | 11/2012 |
| WO | WO 2016/151849 | A1 | 9/2016 |

OTHER PUBLICATIONS

International Search Report for International Application No. PCT/JP2017/013028, dated Jun. 27, 2017.
Written Opinion of the International Searching Authority for International Application No. PCT/JP2017/013028, dated Jun. 27, 2017, with English translation.

* cited by examiner

IMPELLER AND CENTRIFUGAL COMPRESSOR

TECHNICAL FIELD

The present invention relates to an impeller of a centrifugal compressor.

BACKGROUND ART

A centrifugal compressor is configured to include a housing, an impeller rotatably located inside the housing, and a drive device which rotates the impeller. The impeller is rotated by the drive device, and a fluid is suctioned into the housing from a front side of the impeller in an axial direction. The suctioned fluid is pressurized by the impeller, and is discharged outward of the housing.

A centrifugal compressor assembly is known which includes the impeller having a separate exducer blade and an inducer blade, and which has a centrifugal compressor stage having a row of stationary stator vanes arranged between the exducer blade and the inducer blade (for example, refer to PTL).

CITATION LIST

Patent Literature

[PTL 1] Japanese Unexamined Patent Application Publication No. 2012-233475

SUMMARY OF INVENTION

Technical Problem

A centrifugal compressor has a flow path whose radius increases toward a downstream-side in a fluid flowing direction. Therefore, in the centrifugal compressor, solidity (chord ratio) functioning as one of design indicators of the number of blades decreases on the downstream-side where the radius increases. If the solidity excessively decreases, there is a possibility that a fluid flow may not sufficiently be deflected. If the solidity excessively increases, there is a possibility of an increase in friction loss.

In the related art, a splitter blade is added to an inter-blade pitch on the downstream-side so as to increase solidity. However, if the splitter blade is added to the inter-blade pitch, in some cases, a region may appear in which the solidity excessively increases.

The present invention is made in order to solve the above-described problem, and an object thereof is to provide an impeller and a centrifugal compressor in which solidity properly increases on a downstream-side in a fluid flowing direction.

Solution to Problem

According to the present invention, in order to achieve the above-described object, there is provided an impeller including an annular hub having a circular sectional shape formed in an axial direction, a plurality of first blades arranged on an outer peripheral surface of the hub, and a plurality of second blades arranged on a downstream-side a fluid flowing direction from each trailing edge of the first blades, on the outer peripheral surface of the hub. The number of the second blades is smaller than twice the number of the first blades.

According to this configuration, the second blades whose number of blades is smaller than twice the number of the first blades are disposed on the downstream-side in the fluid flowing direction from the trailing edge of the first blade. In this manner, solidity can properly increase on the downstream-side in the fluid flowing direction.

In the impeller according to the present invention, each leading edge of the second blades may be located on the downstream-side in the fluid flowing direction from a position of ½ of a meridian plane length.

According to this configuration, the solidity can properly increase at a position of the meridian plane length in which the solidity decreases, on the downstream-side in the fluid flowing direction.

In the impeller according to the present invention, the number of the first blades and the number of the second blades may be relatively prime.

According to this configuration, the first blade and the second blade are arranged so as not to be juxtaposed with each other in the flowing direction. In this manner, it is possible to prevent performance of the second blade from becoming poor.

In addition, according to the present invention, there is provided a centrifugal compressor including an impeller including an annular hub having a circular sectional shape formed in an axial direction, a plurality of first blades arranged on an outer peripheral surface of the hub, and a plurality of second blades arranged on a downstream-side in a fluid flowing direction from each trailing edge of the first blades, on the outer peripheral surface of the hub, a housing that accommodates the impeller in an internal space so as to rotatably support the impeller, a suction passage through which a fluid is suctioned along the axial direction from a leading edge-side of the impeller, and a discharge passage through which the fluid pumped by the impeller is discharged outward in a radial direction of the impeller. The number of the second blades is smaller than twice the number of the first blades.

According to this configuration, the second blades whose number of blades is smaller than twice the number of the first blades are disposed on the downstream-side in the fluid flowing direction from the trailing edge of the first blade. In this manner, the solidity can properly increase on the downstream-side in the fluid flowing direction.

Advantageous Effects of Invention

According to the impeller and the centrifugal compressor of the present invention, the solidity can properly increase on the downstream-side in the fluid flowing direction.

DESCRIPTION OF EMBODIMENTS

Hereinafter, embodiments according to the present invention will described in detail with reference to the accompanying drawings. The present invention is not limited the embodiments. In addition, configuration elements in the following embodiments include those which can be easily replaced by those skilled in the art or those which are substantially the same. Furthermore, the configuration elements described below can be appropriately combined with each other. In a case where there are provided a plurality of embodiments, the respective embodiments can also be combined with each other.

First Embodiment

Figure 1:
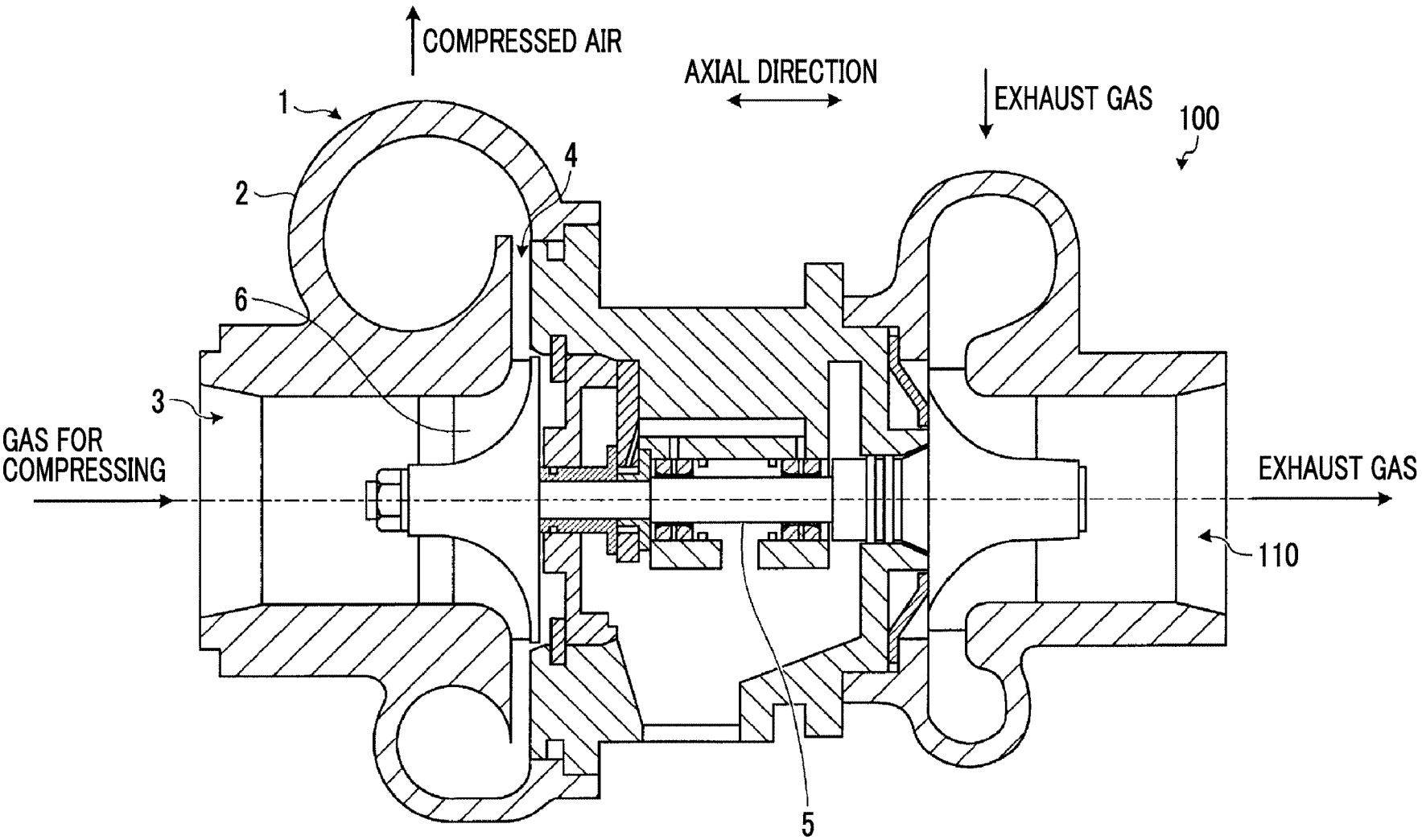
FIG. 1 is a sectional view of a turbocharger including a centrifugal compressor according to a first embodiment.
Figure 2:
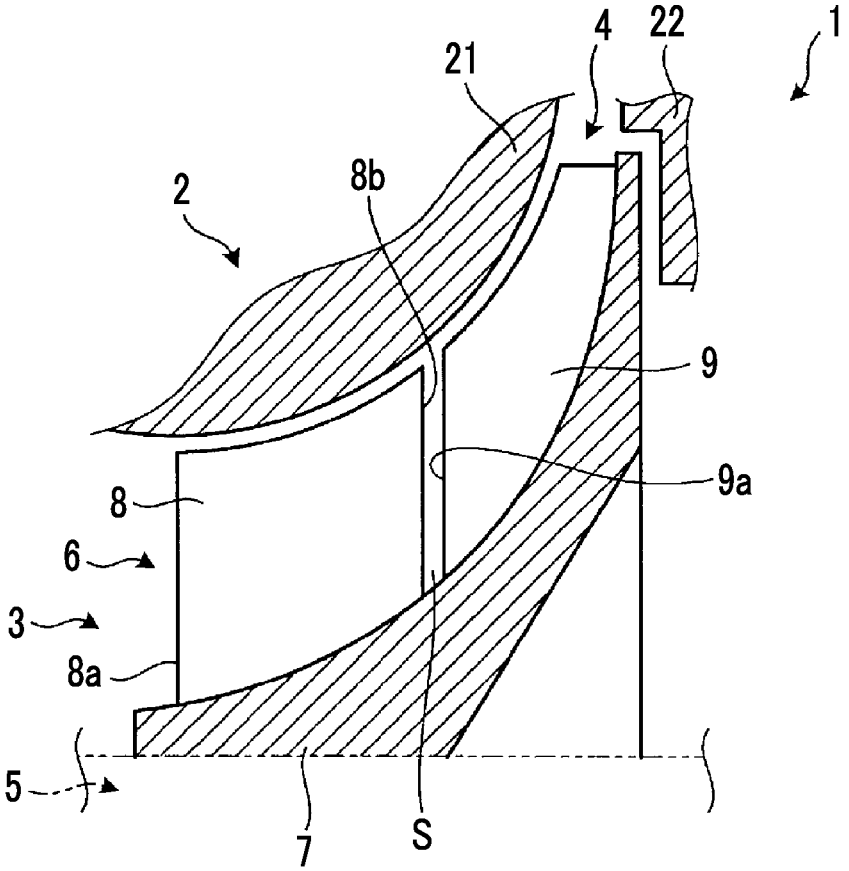
FIG. 2 is a sectional view of an impeller of the centrifugal compressor according to the first embodiment.

FIG. 1 is a sectional view of a turbocharger including a centrifugal compressor according to a first embodiment. FIG. 2 is a sectional view of an impeller of the centrifugal compressor according to the first embodiment. In the present embodiment, an exhaust turbine turbocharger 100 will be described as an example of the turbocharger to which a centrifugal compressor is applied.

As illustrated in FIG. 1, in the exhaust turbine turbocharger 100, a turbine 110 is driven by exhaust gas discharged from an engine (not illustrated), and rotation of the turbine 110 is transmitted via a rotary shaft 5, thereby driving the centrifugal compressor 1.

The centrifugal compressor 1 is applied to automobiles, ships, other industrial machines, or blowers, for example. As illustrated in FIGS. 1 and 2, the centrifugal compressor 1 has a housing 2, a suction passage 3, a discharge passage (diffuser) 4, a rotary shaft 5, and an impeller 6. The centrifugal compressor 1 rotates the rotary shaft 5. In this manner, the impeller 6 is rotated, and a fluid is suctioned into the housing 2 via the suction passage 3. The suctioned fluid is pressurized by the rotating impeller 6, and is discharged out of the discharge passage 4. Then, dynamic pressure of the pressurized fluid is converted into static pressure, and is discharged outward of a discharge port (not illustrated).

The housing 2 is formed in a hollow shape. The housing 2 accommodates the rotary shaft 5 and the impeller 6 in an internal space.

The suction passage 3 suctions the fluid into the housing 2 along an axial direction of the rotary shaft 5 (hereinafter, referred to as an "axial direction"). The suction passage 3 is divided by a shroud 21 of the housing 2. The suction passage 3 supplies the suctioned fluid to a front portion of the impeller 6.

The discharge passage 4 discharges the fluid pressurized by the impeller 6 outward in a radial direction of the rotary shaft 5 (hereinafter, referred to as a "radial direction"). The discharge passage 4 is divided by the shroud 21 and a shroud 22 of the housing 2.

The rotary shaft 5 is rotatably and pivotally supported in the internal space of the housing 2. The turbine 110 serving as a drive device is connected to one end portion of the rotary shaft 5. The rotary shaft 5 is rotated around an axis by the turbine 110. In the rotary shaft 5, the impeller 6 is fixed to an outer peripheral portion via a hub 7.

The impeller 6 compresses the fluid suctioned from the suction passage 3, and discharges the pressurized fluid via the discharge passage 4. The impeller 6 has a hub 7, a first blade 8, and a second blade 9.

The hub 7 is formed in an annular shape having a circular sectional shape formed in the axial direction. The hub 7 is formed in a curved shape recessed outward from the inside in the radial direction as an outer peripheral surface of the hub 7 is away from the suction passage 3 along the axial direction. The hub 7 is fixed to an outer peripheral surface of the rotary shaft 5. The hub 7 is rotated around an axis in conjunction with the rotation of the rotary shaft 5. A plurality of the first blades 8 and a plurality of second blades 9 are arranged on the outer peripheral surface of the hub 7.

The first blades 8 are arranged on an upstream-side (hereinafter, an "upstream-side") in a fluid flowing direction in the impeller 6. More specifically, the first blades 8 are arranged on the upstream-side from a leading edge 9*a* of the second blade 9. The plurality of first blades 8 are arranged along the outer peripheral surface of the hub 7. The plurality of first blades 8 are arranged on the outer peripheral surface of the hub 7 at an equal interval in a circumferential direction.

The second blades 9 are arranged on a downstream-side (hereinafter, a "downstream-side") in the fluid flowing direction in the impeller 6. More specifically, the second blades 9 are arranged on the downstream-side from a trailing edge 8*b* of the first blade 8. A gap S is open between the leading edge 9*a* of the second blade 9 and the trailing edge 8*b* of the first blade 8. The plurality of second blades 9 are arranged along the outer peripheral surface of the hub 7. The plurality of second blades 9 are arranged on the outer peripheral surface of the hub 7 at an equal interval in the circumferential direction.

In the second blade 9, a tip-side of the leading edge 9*a* is located at a position of a dimensionless meridian plane length m of the impeller 6, in which a decrement of solidity $\sigma$ of the impeller 6 increases. The dimensionless meridian plane length m of the impeller 6 in which the decrement of the solidity $\sigma$ of the impeller 6 increases is equal to or greater than 0.5. According to the present embodiment, the tip-side of the leading edge 9*a* is located at a position where the dimensionless meridian plane length m of the impeller 6 is 0.5.

In the second blade 9, the position of the leading edge 9*a* on the hub 7 side is not limited. For example, as illustrated in FIG. 2, the hub 7 side of the leading edge 9*a* may be located at a position where a straight line extending along the radial direction after passing through the position of the tip-side of the leading edge 9*a* intersects the hub 7. Alternatively, for example, the hub 7 side of the leading edge 9*a* may be located at a position where the straight line extending along the axial direction after passing through the position on the tip-side of the leading edge 9*a* intersects the hub 7.

According to the present embodiment, the solidity σ is defined by a blade meridian plane code length/an inter-blade pitch. If the solidity σ excessively decreases, a fluid flow of is not sufficiently deflected. If the solidity σ excessively increases, there a possibility that a friction loss may increase. Therefore, it is preferable that the solidity σ falls within a proper range (target range). According to the present embodiment, for example, the target range of the solidity σ is set to fall within $\sigma_{low}$ to $\sigma_{high}$.

Figure 3:
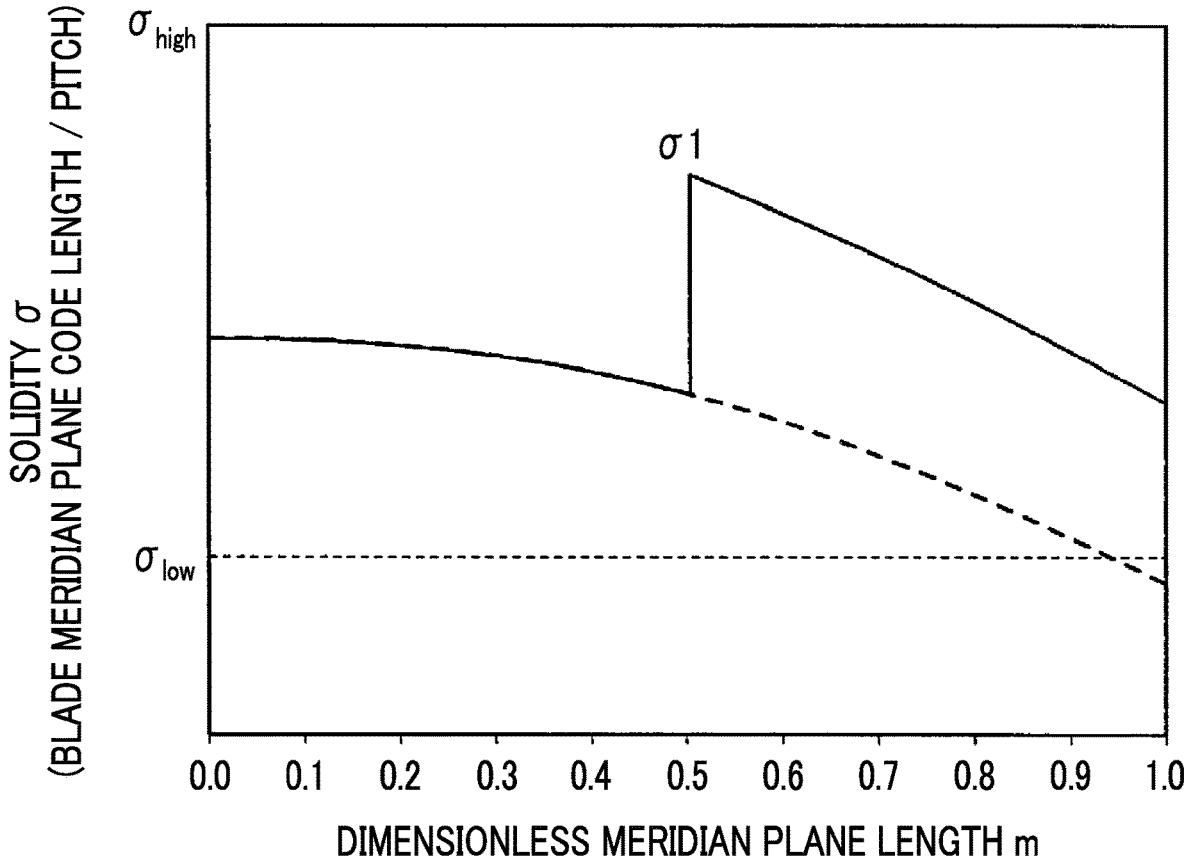
FIG. 3 is a graph illustrating an example of a relationship between a dimensionless meridian plane length and solidity of the impeller of the centrifugal compressor according to the first embodiment.

Referring to FIG. 3, a change in the solidity σ with respect to the dimensionless meridian plane length m. FIG. 3 is a graph illustrating an example of a relationship between the dimensionless meridian plane length and the solidity of the impeller of the centrifugal compressor according to the first embodiment. A dashed line indicates the solidity σ of the impeller having eight blades in the related art. A solid line indicates the solidity σ of the impeller 6 having eight first blades 8 and ten second blades 9 according to the present embodiment. The solidity σ of the impeller in the related art sharply decreases, particularly as the dimensionless meridian plane length m increases from when the dimensionless meridian plane length m is approximately 0.5.

A position for locating the second blade 9 and the number of the second blades 9 are selected so that the solidity σ falls within a proper range in a region where the solidity σ decreases.

In order to increase the solidity σ in the region where the solidity σ decreases, the second blade 9 is located in the region where the solidity σ decreases. In this manner, according to the present embodiment, the second blade 9 is located by locating the tip-side of the leading edge 9*a* of the second blade 9 at a position where the dimensionless meridian plane length m is 0.5.

The number of blades is selected so that the solidity σ falls within the proper range in addition to the second blades 9. Furthermore, the number of the second blades 9 is set to be smaller than twice the number of the first blades 8. In other words, the number of the second blades 9 is set to be equal to or smaller than the number of splitter blades arranged one to one with respect to the blades in the related art. Furthermore, the number of the second blades 9 is set to be equal to or larger than the number of the first blade 8. In this manner, according to the present embodiment, the number of the second blades 9 is ten.

Figure 4:
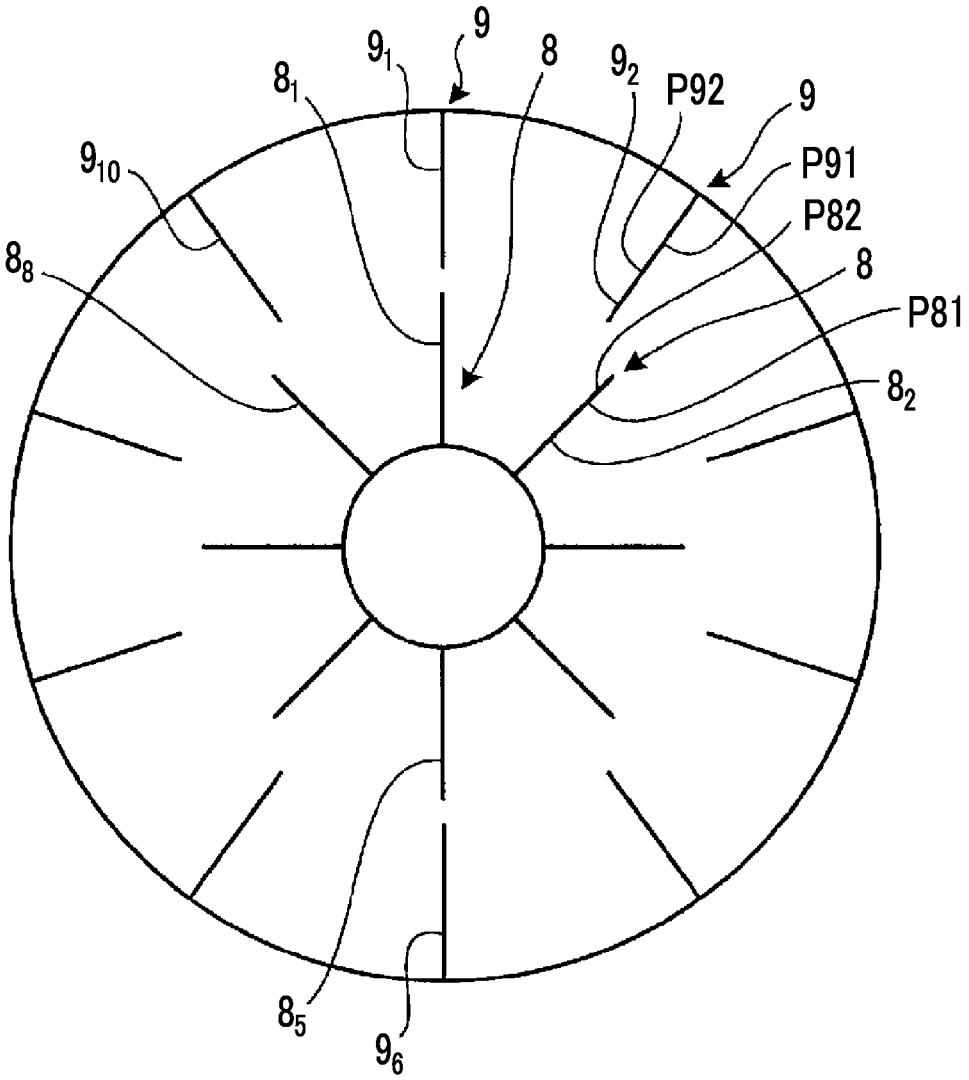
FIG. 4 is a schematic view illustrating an arrangement of a first blade and a second blade of the impeller of the centrifugal compressor according to the first embodiment.
Figure 5:
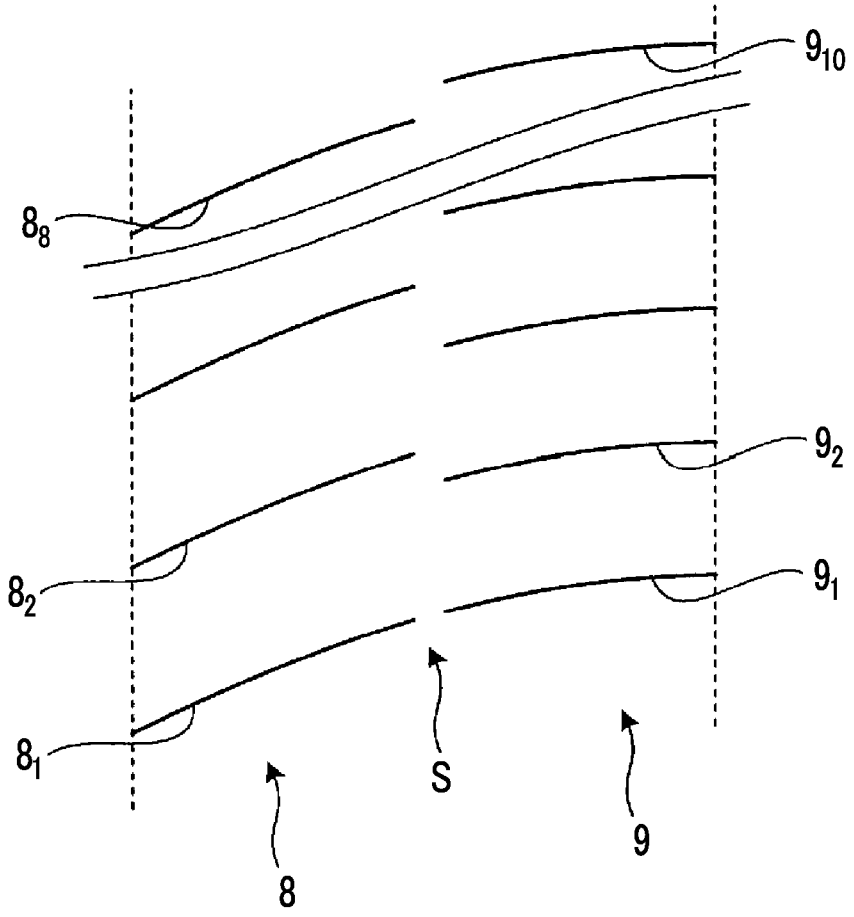
FIG. 5 is a schematic view illustrating an arrangement of the first blade and the second blade of the impeller of the centrifugal compressor according to the first embodiment.

Referring to FIGS. 4 and 5, an arrangement of the first blade 8 and the second blade 9 according to the present embodiment will be described. FIG. 4 is a schematic view illustrating the arrangement of the first blade and the second blade of the impeller of the centrifugal compressor according to the first embodiment. FIG. 5 is a schematic view illustrating the arrangement of the first blade and the second blade of the impeller of the centrifugal compressor according to the first embodiment. According to the present embodiment, the tip-side of the leading edge 9*a* of the second blade 9 is located at a position where the dimensionless meridian plane length m is 0.5. In other words, according to the present embodiment, the dimensionless meridian plane length m of the first blade 8 and the dimensionless meridian plane length m of the second blade 9 are the same as each other. According to the present embodiment, eight pieces of the first blade 8 and ten pieces of the second blade 9 are arranged. According to the present embodiment, a first blade $\mathbf{8}_1$ and a second blade $\mathbf{9}_1$, and a first blade $\mathbf{8}_5$ and a second blade $\mathbf{9}_6$ are juxtaposed with each other in the fluid flowing direction.

Next, an operation of the impeller 6 configured in this way will be described.

If the impeller 6 is rotated by the turbine 110, the fluid suctioned from the suction passage 3 flows into the impeller 6. According to the present embodiment, eight pieces of the first blade 8 are arranged on the upstream-side of the impeller 6. According to the present embodiment, ten pieces of the second blade 9 are arranged on the downstream-side of the impeller 6. The gap S is open between the trailing edge 8*b* of the first blade 8 and the leading edge 9*a* of the second blade 9.

If the fluid flows into the first blade 8 from the leading edge 8*a*, the fluid is pressurized until the fluid passes through the trailing edge 8*b* of the first blade 8. The pressurized fluid flows from a blade pressure surface P81 side of the trailing edge 8*b* of the first blade 8 toward a blade negative pressure surface P92 side of the leading edge 9*a* of the second blade 9 via the gap S. In this manner, momentum is exchanged between the blade pressure surface P81 side and the blade negative pressure surface P92 side, and the flow is made uniform. In this way, a boundary layer on the blade negative pressure surface P92 of the second blade 9 is prevented from being developed. Airflow is prevented from being separated on the blade pressure surface P81 side of the trailing edge 8*b* of the first blade 8.

The number of the first blades 8 is different from the number of the second blades 9. Accordingly, for example, as illustrated in FIG. 4, a positional relationship between the first blade 8 and the second blade 9 is not uniform in the circumferential direction of the impeller 6. In this manner, a fluid flow from the blade pressure surface P81 side of the trailing edge 8*b* of the first blade 8 toward the blade negative pressure surface P92 side of the leading edge 9*a* of the second blade 9 is unlikely to have a biased flow rate in the circumferential direction of the impeller 6.

Referring to FIG. 3, a change in the solidity σ of the impeller 6 configured in this way with respect to the dimensionless meridian plane length m will be described. In the impeller 6, the solidity σ decreases similarly to a dashed line until the dimensionless meridian plane length m decreases to 0.5. When the dimensionless meridian plane length m is 0.5, the solidity σ increases to σ1 and then, decreases. In the impeller 6, while the dimensionless meridian plane length m is between 0.0 and 1.0, the solidity σ falls within a target range. In contrast, the solidity σ of the impeller in the related art decreases below $\sigma_{low}$ when the dimensionless meridian plane length m is approximately equal to or greater than 0.95, and the solidity σ deviates from the target range.

As described above, according to the present embodiment, the second blades 9 whose number of blades is different from the number of the first blades 8 are arranged on the downstream-side of the first blades 8. In this manner, it is possible to increase the solidity σ in a region where the solidity σ decreases. Furthermore, according the present embodiment, the position for arranging the second blades 9 and the number of the second blades 9 are properly selected. Accordingly, an increment in the solidity σ can fall within a proper range.

According to the present embodiment, when the fluid passes through the second blade 9 from the first blade 8, the fluid discharged from the trailing edge 8*b* side of the first blade 8 flows from the blade pressure surface P81 side of the first blade 8 toward the blade negative pressure surface P92 side of the second blade 9. In this manner, according to the present embodiment, the momentum is exchanged between the blade pressure surface P81 side and the blade negative pressure surface P92 side. Accordingly, the fluid flow can be made uniform. In this way, according to the present embodiment, the boundary layer can be prevented from being developed on the blade negative pressure surface P92 of the second blade 9. According to the present embodiment, the airflow can be prevented from being separated on the blade pressure surface P81 side of the trailing edge 8*b* of the first blade 8.

According to the present embodiment, the fluid flows from the blade pressure surface P81 side of the first blade 8 toward the blade negative pressure surface P92 side of the second blade 9. Accordingly, the fluid having low energy can be prevented from staying in the vicinity of the blade negative pressure surface P92 of the second blade 9. In this manner, according to the present embodiment, it is possible to improve impeller efficiency.

According to the present embodiment, the airflow is prevented from being separated on the blade pressure surface P81 side of the trailing edge 8*b* of the first blade 8. In this manner, according to the present embodiment, a wake can be prevented from occurring in the trailing edge 8*b* of the first blade 8. In this way, according to the present embodiment, the loss is reduced, and compression efficiency is prevented from being reduced. Therefore, the performance of the impeller 6 can be prevented from becoming poor.

Furthermore, according to the present embodiment, it is possible to improve the performance of a diffuser and a scroll which are located on the downstream-side.

Figure 10:
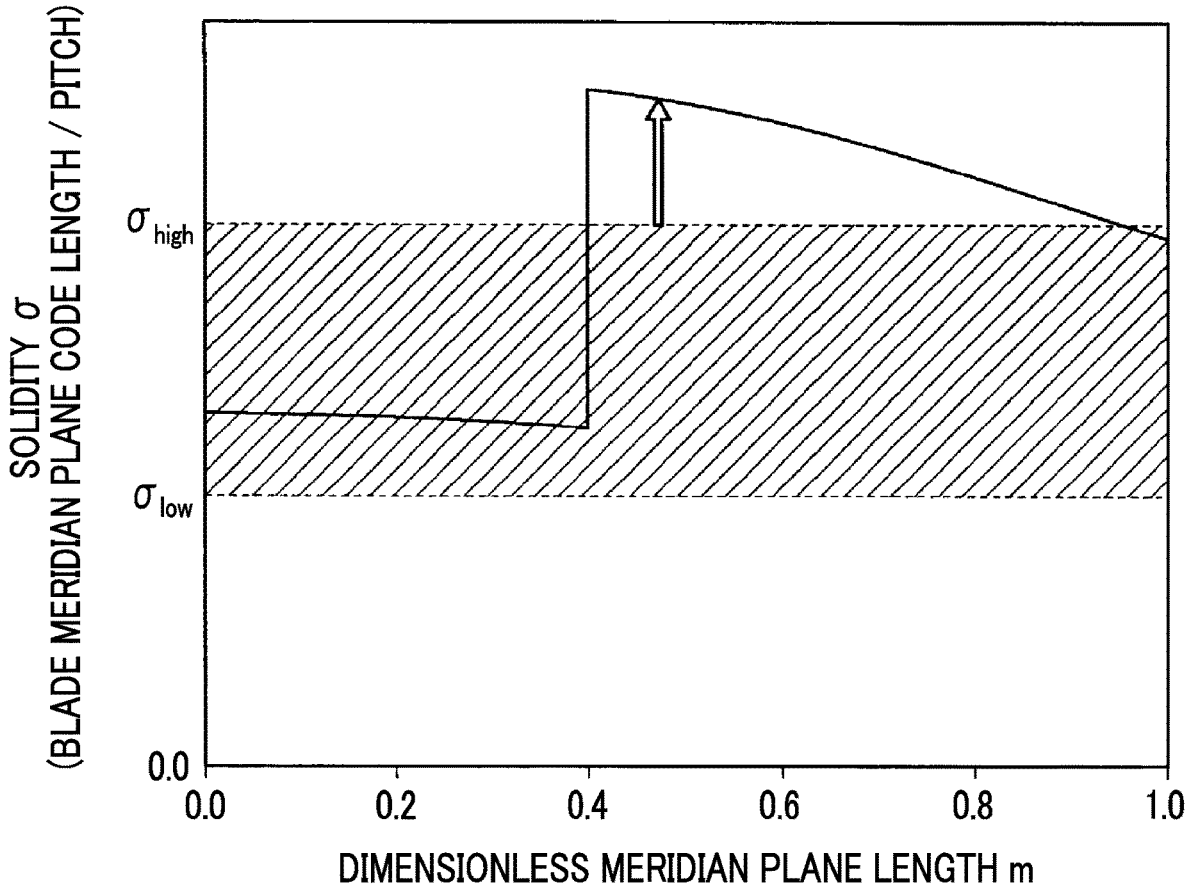
FIG. 10 is a graph illustrating an example of a relationship between a dimensionless meridian plane length and solidity of an impeller of a centrifugal compressor in the related art.
Figure 11:
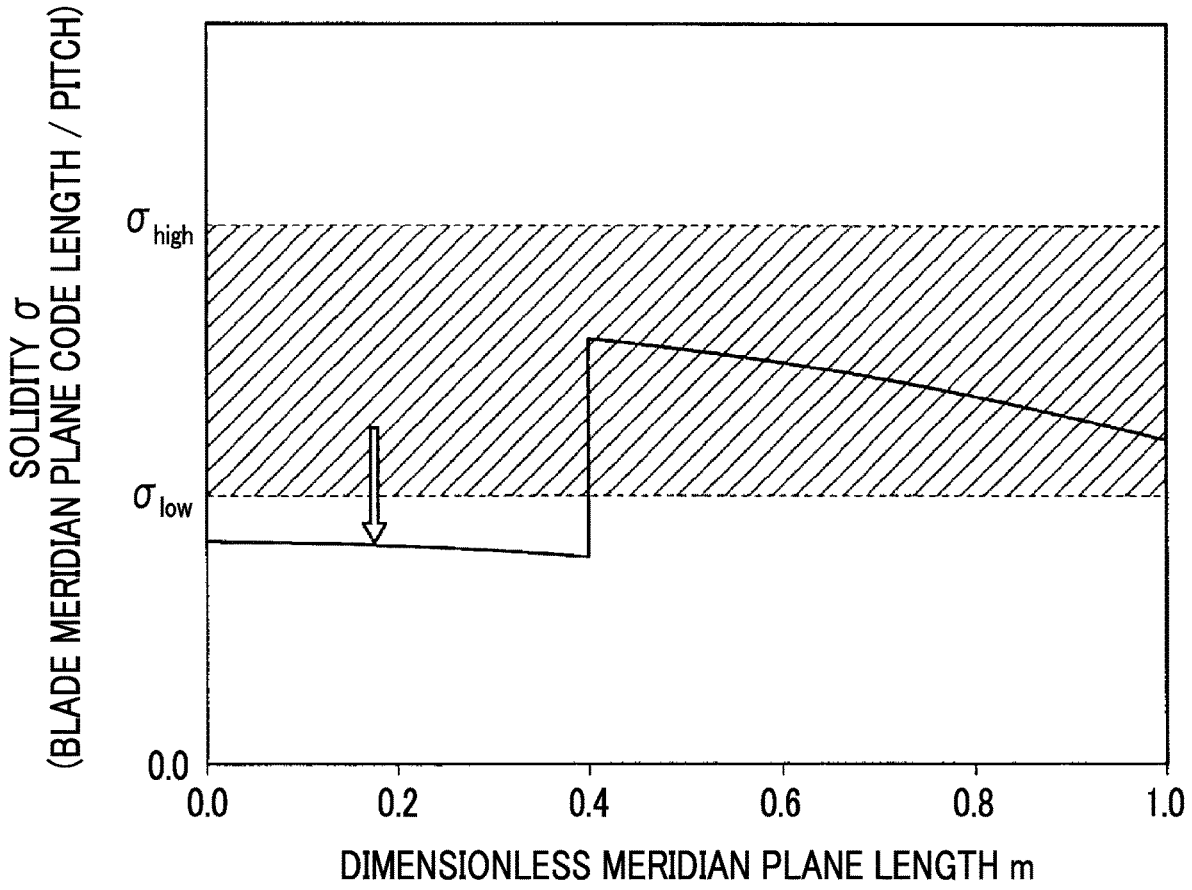
FIG. 11 is a graph illustrating another example of the relationship between the dimensionless meridian plane length and the solidity of the impeller of the centrifugal compressor in the related art.

For the sake of comparison, referring to FIGS. 10 and 11, a case will be described where the splitter blade is disposed in the inter-blade pitch on the downstream-side in which the solidity σ decreases as in the related art. FIG. 10 is a graph illustrating an example of a relationship between the dimensionless meridian plane length and the solidity of the impeller of the centrifugal compressor in the related art. FIG. 11 is a graph illustrating another example of a relationship between the dimensionless meridian plane length and the solidity of the impeller of the centrifugal compressor in the related art. FIG. 10 shows a case where eight splitter blades are added to the eight blades at a position where the dimensionless meridian plane length m is 0.4. FIG. 11 shows a case where five splitter blades are added to the five blades at a position where the dimensionless meridian plane length m is 0.4. In either case, the dimensionless meridian plane length m is 0.4, and the solidity σ increases twice. In FIG. 10, the solidity σ in the leading edge of the splitter blade excessively increases, and there is a region where the solidity σ deviates from a proper range. Therefore, if the solidity σ of the trailing edge of the splitter blade is caused to fall within the proper range, as illustrated in FIG. 11, the solidity σ excessively decreases in the leading edge of the splitter blade, and there is a region where the solidity σ deviates from the proper range. In this way, if the splitter blade is used as in the related art, it is not possible to properly increase the solidity σ.

Second Embodiment

Figure 6:
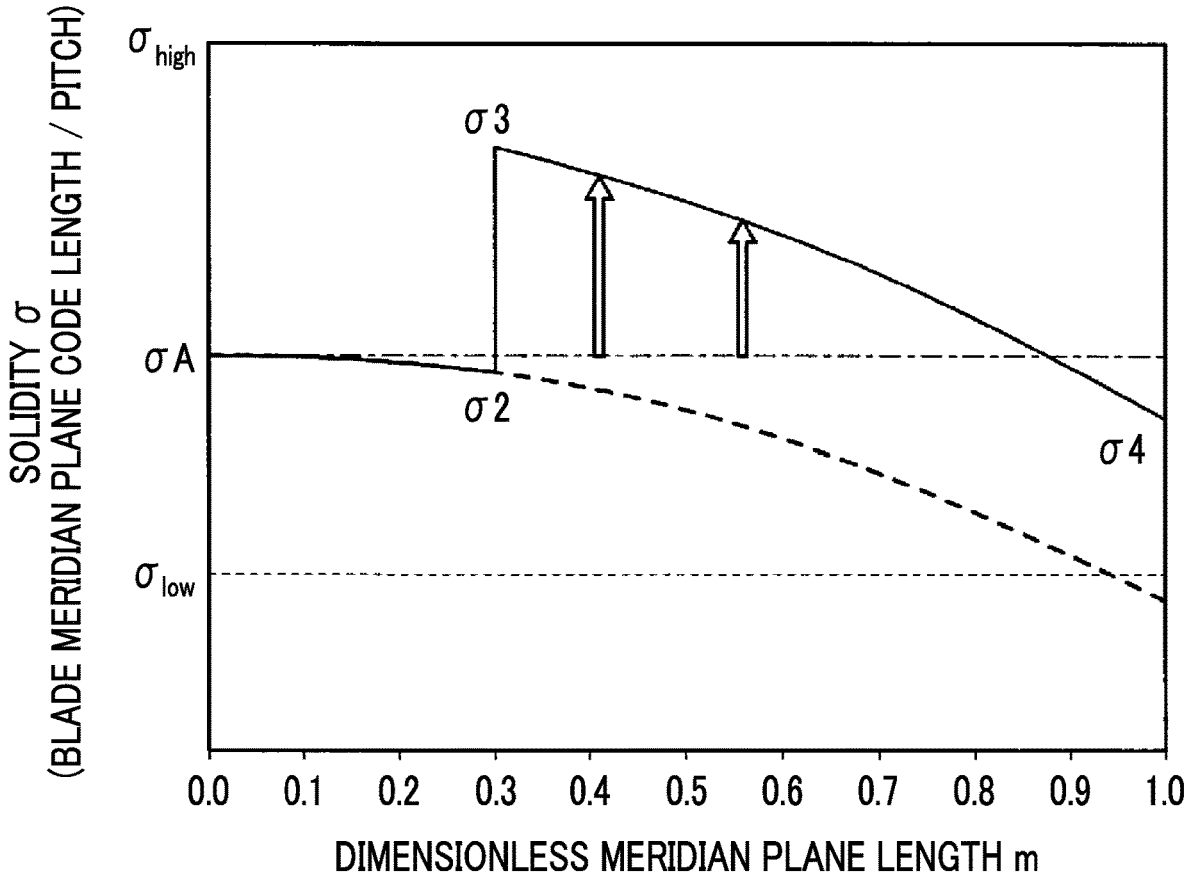
FIG. 6 is a graph illustrating an example of a relationship between a dimensionless meridian plane length and solidity of an impeller of a centrifugal compressor according to a second embodiment.
Figure 7:
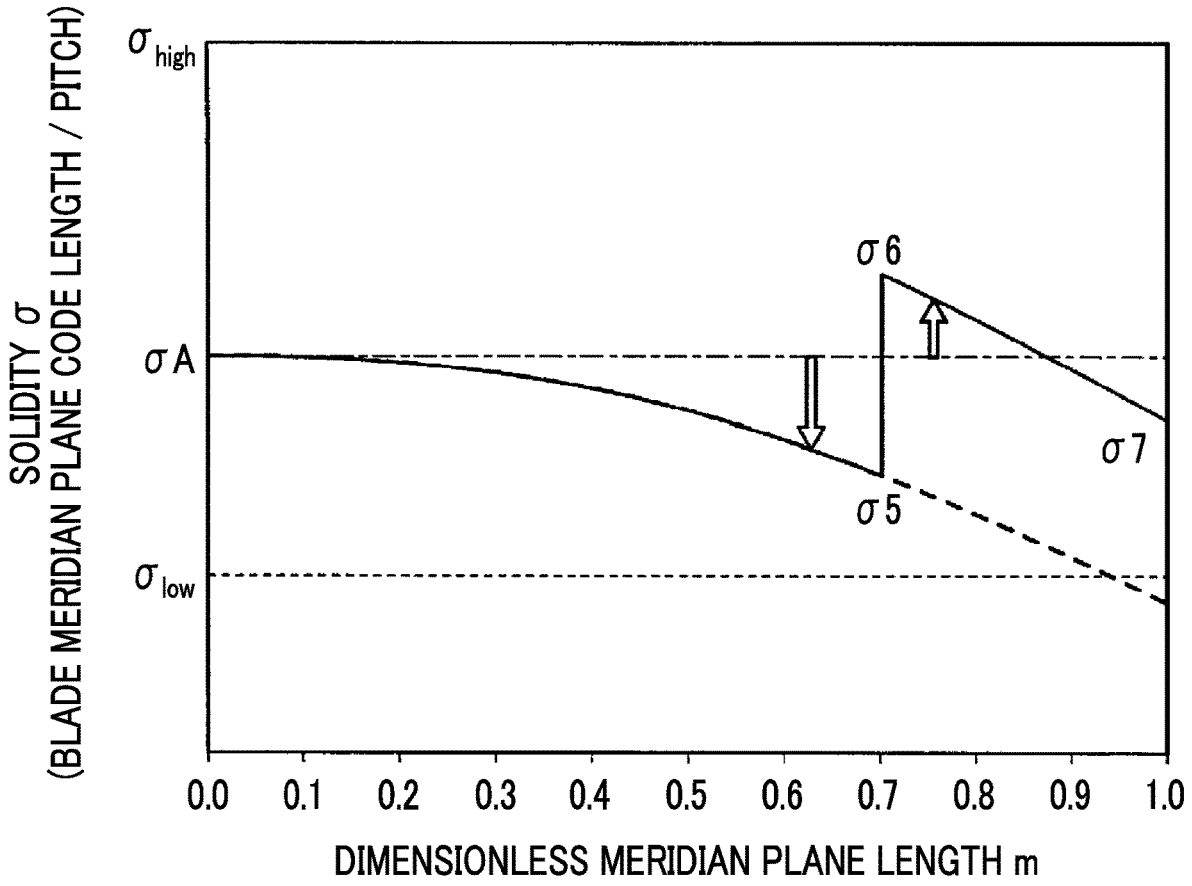
FIG. 7 is a graph illustrating another example of the relationship between the dimensionless meridian plane length and the solidity of the impeller of the centrifugal compressor according to the second embodiment.

Referring to FIGS. 6 and 7, the impeller 6 according to the present embodiment will be described. FIG. 6 is a graph illustrating an example of a relationship between the dimensionless meridian plane length and the solidity of the impeller of the centrifugal compressor according to a second embodiment. FIG. 7 is a graph illustrating another example of a relationship between the dimensionless meridian plane length and the solidity of the impeller of the centrifugal compressor according to the second embodiment. The impeller 6 has a basic configuration which is the same as that of the impeller 6 according to the first embodiment. In the following description, the same reference signs or corresponding reference signs will be given to configuration elements which are the same as those of the impeller 6, and detailed description thereof will be omitted.

In the second blade 9, as described above, the tip-side of the leading edge 9*a* is located at a position of the dimensionless meridian plane length m of the impeller 6 where a decrement in the solidity σ of the impeller 6 increases. According to the present embodiment, it is preferable that the tip-side of the leading edge 9*a* of the second blade 9 is located on the downstream-side from the position where the dimensionless meridian plane length m of the impeller 6 is 0.5. The upstream-side from the position where the dimensionless meridian plane length m of the impeller 6 is 0.5 represents an inducer region where the solidity σ is less changed.

Referring to FIGS. 6 and 7, a change in the solidity σ with respect to the dimensionless meridian plane length m will be described. A dashed line indicates the solidity σ of the impeller having eight blades in the related art. A solid line indicates the solidity σ of the impeller 6 having the eight first blades 8 and the ten second blades 9 according to the present embodiment. According to the present embodiment, the solidity σ is set to σA as a target value.

In FIG. 6, the tip-side of the leading edge 9*a* of the second blade 9 is located at a position where the dimensionless meridian plane length m of the impeller 6 is 0.3. The solidity σ decreases to σ2 similarly to the dashed line until the dimensionless meridian plane length m is 0.3. The solidity σ increases to σ3 when the dimensionless meridian plane length m is 0.3, and then, the solidity σ decreases to σ4 when the dimensionless meridian plane length m is 1.0. In this way, if the tip-side of the leading edge 9*a* is located at the position where the dimensionless meridian plane length m of the impeller 6 is 0.3, a deviation of the solidity σ from the target value increases.

In FIG. 7, the tip-side of the leading edge 9*a* of the second blade 9 is located at a position where the dimensionless meridian plane length m of the impeller 6 is 0.7. The solidity σ decreases to σ5 similarly to the dashed line until the dimensionless meridian plane length is 0.7. The solidity σ increases to σ6 when the dimensionless meridian plane length m is 0.7, and then, the solidity σ decreases to σ7 when the dimensionless meridian plane length m is 1.0. In this way, if the tip-side of the leading edge 9*a* is located at the position where the dimensionless meridian plane length m of the impeller 6 is 0.7, the deviation of the solidity σ from the target value decreases.

If the tip-side of the leading edge 9*a* of the second blade 9 is located at a position where the dimensionless meridian plane length m of the impeller 6 is greater than 0.7, the solidity σ greatly falls below the target value. In other words, if the tip-side of the leading edge 9*a* is located at the position where the dimensionless meridian plane length m of the impeller 6 is greater than 0.7, the deviation of the solidity σ from the target value increases.

As illustrated in FIG. 3, if the tip-side of the leading edge 9*a* of the second blade 9 is located at a position where the dimensionless meridian plane length m of the impeller 6 is 0.5, the solidity σ greatly exceeds the target value at the position where the dimensionless meridian plane length m is 0.5. In other words, if the tip-side of the leading edge 9*a* is located at the position where the dimensionless meridian plane length m of the impeller 6 is 0.5, the deviation of the solidity σ from the target value increases.

For this reason, according to the present embodiment, it is preferable that the tip-side of the leading edge 9*a* of the second blade 9 is located at the position where the dimensionless meridian plane length m of the impeller 6 is 0.7.

Next, an operation of the impeller 6 configured in this way will be described.

In the impeller 6, due to a secondary flow, the fluid having low energy tends to stagnate on a negative pressure surface P82 side of the trailing edge 8*b* of the first blade 8. The fluid flows from the blade pressure surface P81 side of the trailing edge 8*b* of the first blade 8 toward the blade negative pressure surface P92 side of the leading edge 9*a* of the second blade 9. This flows reduces the fluid having low energy staying on the negative pressure surface P82 side of the trailing edge 8*b* of the first blade 8. In this manner, the wake is prevented from occurring in the trailing edge 8*b* of the first blade 8. In this way, the loss is reduced in the impeller 6, and compression efficiency is prevented from being reduced. Therefore, the performance of the impeller 6 is prevented from becoming poor.

As described above, according to the present embodiment, the second blades 9 whose number of blades is different from the number of the first blades 8 are arranged for the first blades 8 on the downstream-side from the position where the dimensionless meridian plane length m of the impeller 6 is 0.5. In this manner, it is possible to properly increase the solidity σ in the region where the solidity σ decreases.

According to the present embodiment, the fluid flows from the blade pressure surface P81 side of the trailing edge 8*b* of the first blade 8 toward the blade negative pressure surface P92 side of the leading edge 9*a* of the second blade 9. This flow can reduce the fluid having low energy which stays on the negative pressure surface P82 side of the trailing edge 8*b* of the first blade 8.

According to the present embodiment, the first blade and the second blade 9 are arranged with the gap S therebetween at the position where the fluid having low energy is likely to stay. In other words, the blades are divided into the first blade 8 and the second blade 9. In this manner, according to the present embodiment, the configuration reduces the fluid having low energy which stays on the negative pressure surface PS2 side of the trailing edge 8*b* of the first blade 8. In this manner, according to the present embodiment, it is possible to effectively eliminate a so-called jet-wake structure in which an outlet flow of the centrifugal compressor 1 is not uniform in the circumferential direction.

Third Embodiment

Figure 8:
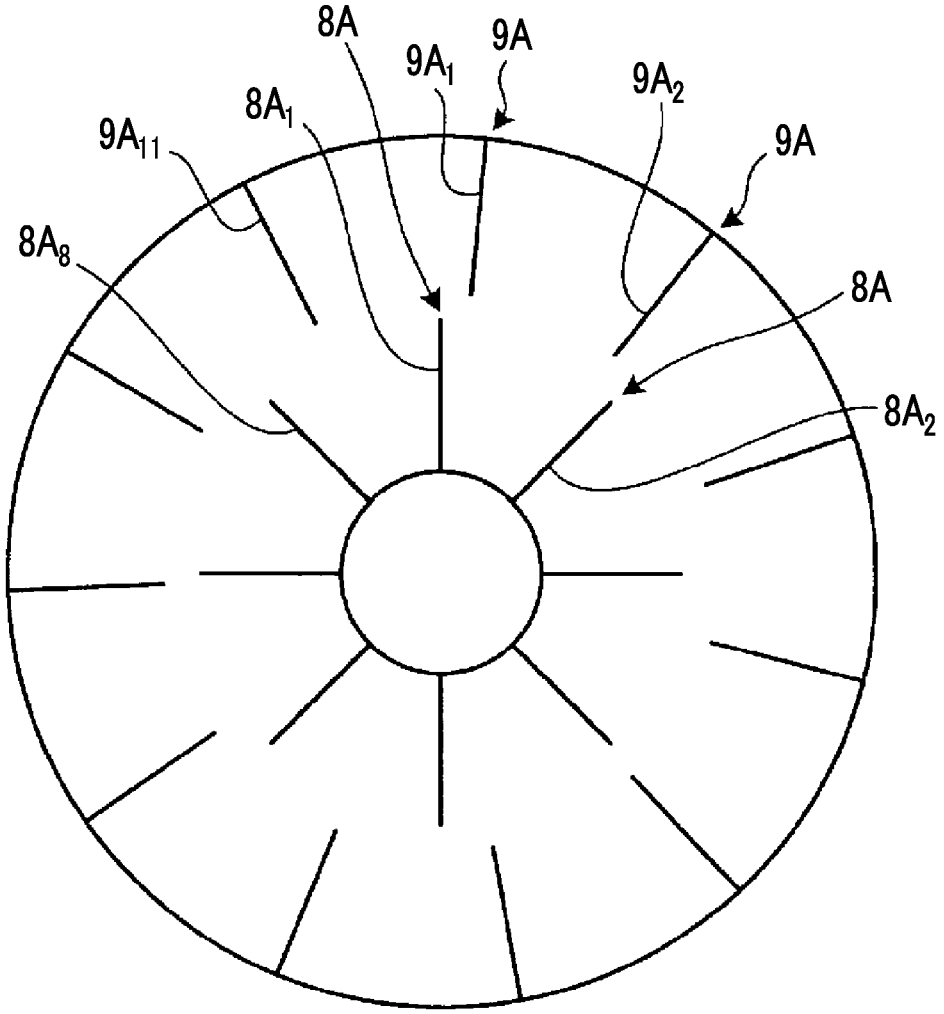
FIG. 8 is a schematic view illustrating an arrangement of a first blade and a second blade of an impeller of a centrifugal compressor according to a third embodiment.
Figure 9:
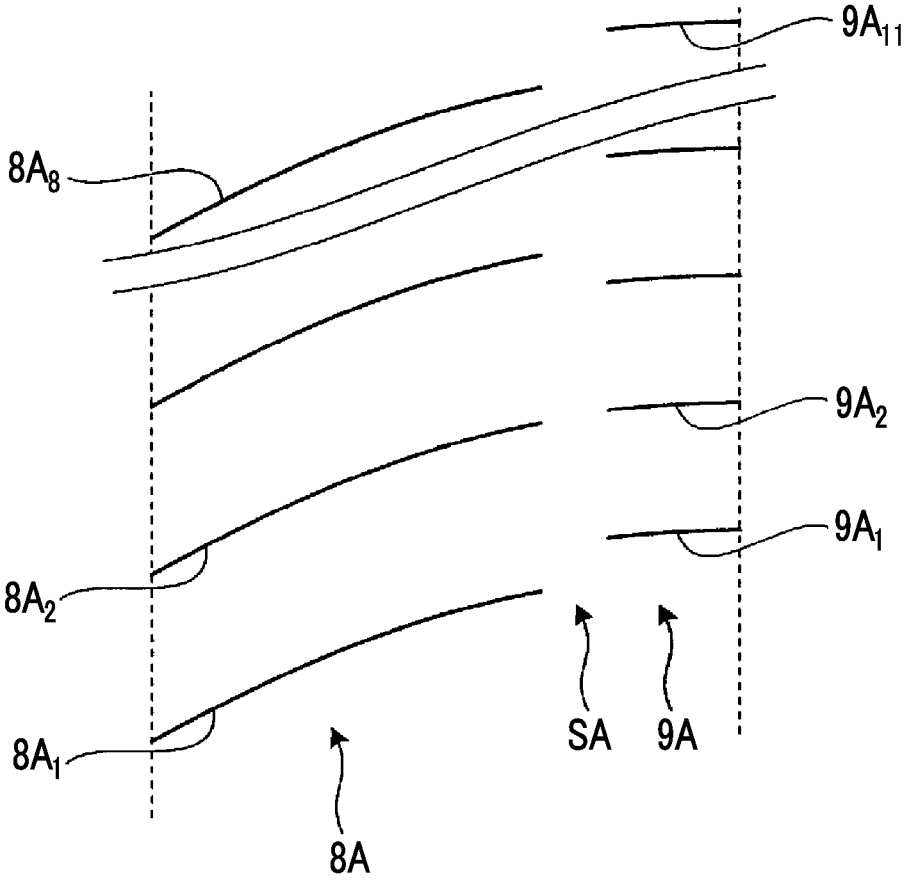
FIG. 9 is a schematic view illustrating an arrangement of the first blade and the second blade of the impeller of the centrifugal compressor according to the third embodiment.

Referring to FIGS. 8 and 9, the impeller 6 according to the present embodiment will be described. FIG. 8 is a schematic view illustrating an arrangement of the first blade and the second blade of the impeller of the centrifugal compressor according to a third embodiment. FIG. 9 is a schematic view illustrating an arrangement of the first blade and the second blade of the impeller of the centrifugal compressor according to the third embodiment.

The number of first blades 8A and the number of second blades 9A are relatively prime. According to the present embodiment, eight pieces of the first blade 8A are arranged, and eleven pieces of the second blade 9A are arranged. The first blades 8A and the second blades 9A are arranged by being shifted from each other on the outer peripheral surface of the hub 7 so as not to be juxtaposed with each other in the fluid flowing direction.

According to the present embodiment, a first blade $\mathbf{8}_1$ to a first blade $\mathbf{8}_8$ and a second blade $\mathbf{9}_1$ to a second blade $\mathbf{9}_{11}$ are all arranged by being shifted from each other in the fluid flowing direction.

Next, an operation of the impeller 6 configured in this way will be described.

The first blade 8A and the second blade 9A are not juxtaposed with each other on the outer peripheral surface of the hub 7 in the fluid flowing direction. Therefore, the wake occurring in the trailing edge of the first blade 8A is prevented from interfering with the second blade 9A.

As described above, according to the present embodiment, the first blades 8A and the second blades 9A have the numbers of blades which are relatively prime, and are not juxtaposed with each other on the outer peripheral surface of the hub 7 in the fluid flowing direction. In this manner, according to the present embodiment, the wake occurring in the trailing edge of the first blade 8A can be prevented from interfering with the second blade 9A. In this manner, according to the present embodiment, the performance of the second blade 9A can be prevented from becoming poor.

In contrast, in a case where the number of the first blades and the number of the second blades are not relatively prime, there is a possibility that a positional relationship between the first blade and the second blade may be periodic in the circumferential direction. In particular, if the first blade and the second blade are arranged at positions juxtaposed with each other in the fluid flowing direction, the wake occurring in the trailing edge of the first blade may interfere with the second blade, thereby causing a possibility that the performance of the second blade may become poor.

REFERENCE SIGNS LIST

1: centrifugal compressor
2: housing
3: suction passage
4: discharge passage
5: rotary shaft
6: impeller
7: hub
8: first blade
8*b*: trailing edge
9: second blade
9*a*: leading edge
100: exhaust turbine turbocharger
110: turbine
S: gap

The invention claimed is:

1. An impeller comprising:

an annular hub having a circular sectional shape formed in an axial direction;

a plurality of first blades arranged circumferentially on an outer peripheral surface of the hub; and a plurality of second blades arranged circumferentially on a downstream-side in a fluid flowing direction from each trailing edge of the plurality of first blades, on the outer peripheral surface of the hub, wherein the number of the plurality of second blades is larger than the number of the plurality of first blades, and is smaller than twice the number of the plurality of first blades, and wherein the number of the plurality of first blades and the number of the plurality of second blades are relatively prime.

2. The impeller according to claim 1, wherein each leading edge of the plurality of second blades is located on the downstream-side in the fluid flowing direction from a position of ½ of a meridian plane length.

3. A centrifugal compressor comprising:

an impeller including an annular hub having a circular sectional shape formed in an axial direction, a plurality of first blades arranged circumferentially on an outer peripheral surface of the hub, and a plurality of second blades arranged circumferentially on a downstream-side in a fluid flowing direction from each trailing edge of the plurality of first blades, on the outer peripheral surface of the hub;

a housing that accommodates the impeller in an internal space so as to rotatably support the impeller;

a suction passage through which a fluid is suctioned along the axial direction from a leading edge-side of the impeller; and a discharge passage through which the fluid pumped by the impeller is discharged outward in a radial direction of the impeller, wherein the number of the plurality of second blades is larger than the number of the plurality of first blades, and is smaller than twice the number of the plurality of first blades, and wherein the number of the plurality of first blades and the number of the plurality of second blades are relatively prime.

* * * * *